United States Patent [19]

Cho et al.

[11] Patent Number: 4,876,763

[45] Date of Patent: Oct. 31, 1989

[54] VACUUM CLEANER

[75] Inventors: Hae S. Cho; In K. Kwon, both of Suwon, Rep. of Korea

[73] Assignee: Samsung Electronics Co., Ltd., Suwon, Rep. of Korea

[21] Appl. No.: 289,220

[22] Filed: Dec. 22, 1988

[30] Foreign Application Priority Data

Dec. 31, 1987 [KR] Rep. of Korea ..... 87-15664

[51] Int. Cl.[4] ..... A47L 9/32

[52] U.S. Cl. ..... 15/329; 15/410

[58] Field of Search ..... 15/329, 410, 145

[56] References Cited

U.S. PATENT DOCUMENTS

| | | | |
|---|---|---|---|
| 2,986,765 | 6/1961 | Ernolf et al. | 15/410 X |
| 3,142,857 | 8/1964 | Fresard et al. | 15/410 X |
| 4,644,605 | 2/1987 | Joss et al. | 15/329 |
| 4,662,026 | 5/1987 | Sumerau et al. | 15/329 |
| 4,715,084 | 12/1987 | Jacob et al. | 15/329 X |
| 4,766,638 | 8/1988 | McDowell | 15/329 |

FOREIGN PATENT DOCUMENTS

| | | | |
|---|---|---|---|
| 691311 | 7/1964 | Canada | 15/329 |
| 285755 | 1/1953 | Switzerland | 15/329 |

*Primary Examiner*—Chris K. Moore

*Attorney, Agent, or Firm*—Lieberman, Rudolph & Nowak

[57] ABSTRACT

A vacuum cleaner of the present invention can be selectively transformed into a portable, hand-carried position, or a floor-carried, upright position, by changing the position of its handle incorporated with an extension member. Simple connecting means are utilized for changing the position of the handle.

3 Claims, 4 Drawing Sheets

VACUUM CLEANER

BACKGROUND OF THE INVENTION

The present invention concerns a vacuum cleaner whose handle, incorporating an extension member, is made to be able to change its position according to the use of the vacuum cleaner.

Conventional vacuum cleaners are generally distinguished into two types, i.e., one for a floor-carried, upright position, and the other for a portable hand-carried position. With the floor-carried, upright vacuum cleaner, the user performs a cleaning operation in standing position by pulling or pushing the vacuum cleaner, which makes it difficult to clean the surface of furniture, or the surfaces existing relatively high.

With the portable, hand-carried vacuum cleaner, which facilitates cleaning the surfaces of furniture or surfaces existing relatively high, it is difficult for the user to clean the floor in a standing position. Therefore, a plurality of connecting pipes are associated with the suction port of the vacuum cleaner so as to form the floor-carried, upright type, for cleaning the floor.

In the present invention, when using the vacuum cleaner again as the portable hand-carried type, the connecting pipes are detached from the vacuum cleaner and stored separately. Consequently, according to the use, attaching and detaching of the connecting pipes is to be repeated, which brings inconveniences to the user and causes loss of the connecting pipes.

SUMMARY OF THE INVENTION

The object of the present invention is to provide a vacuum cleaner which obviates the above drawbacks and can easily be adjusted to the floor-carried, upright position, or to the portable hand-carried position.

The vacuum cleaner of the present invention comprises a body having an air suction port at its front and a plurality of air discharging openings at its back, an air suction means placed inside said body, a suction nozzle attached to said air suction port, a front upper cap mounted on the front upper side of said body, a rear upper cap mounted on the rear upper side of said body, a handle incorporated with an extension member, a holding means provided on the free end of said extension member, a catching means provided on the front upper end of said front upper cap, a cut formed in the free end of said handle, a hooking means provided on the back side of said rear upper cap, and a catching hole formed into the back side of said body, characterized in that when said vacuum cleaner is used as a portable hand-carried type, said holding means of said extension member, and said cut of said handle, are immovably caught respectively by said catching means and said hooking means of said rear upper cap, and when said vacuum cleaner is used as a floor-carried, upright type, said holding means is inserted into said catching hole of said body and immovably caught therein.

BEST MODE FOR CARRYING OUT THE PRESENT INVENTION

This invention will now be described specifically with reference to the drawings attached only by way of example.

Figure 1:
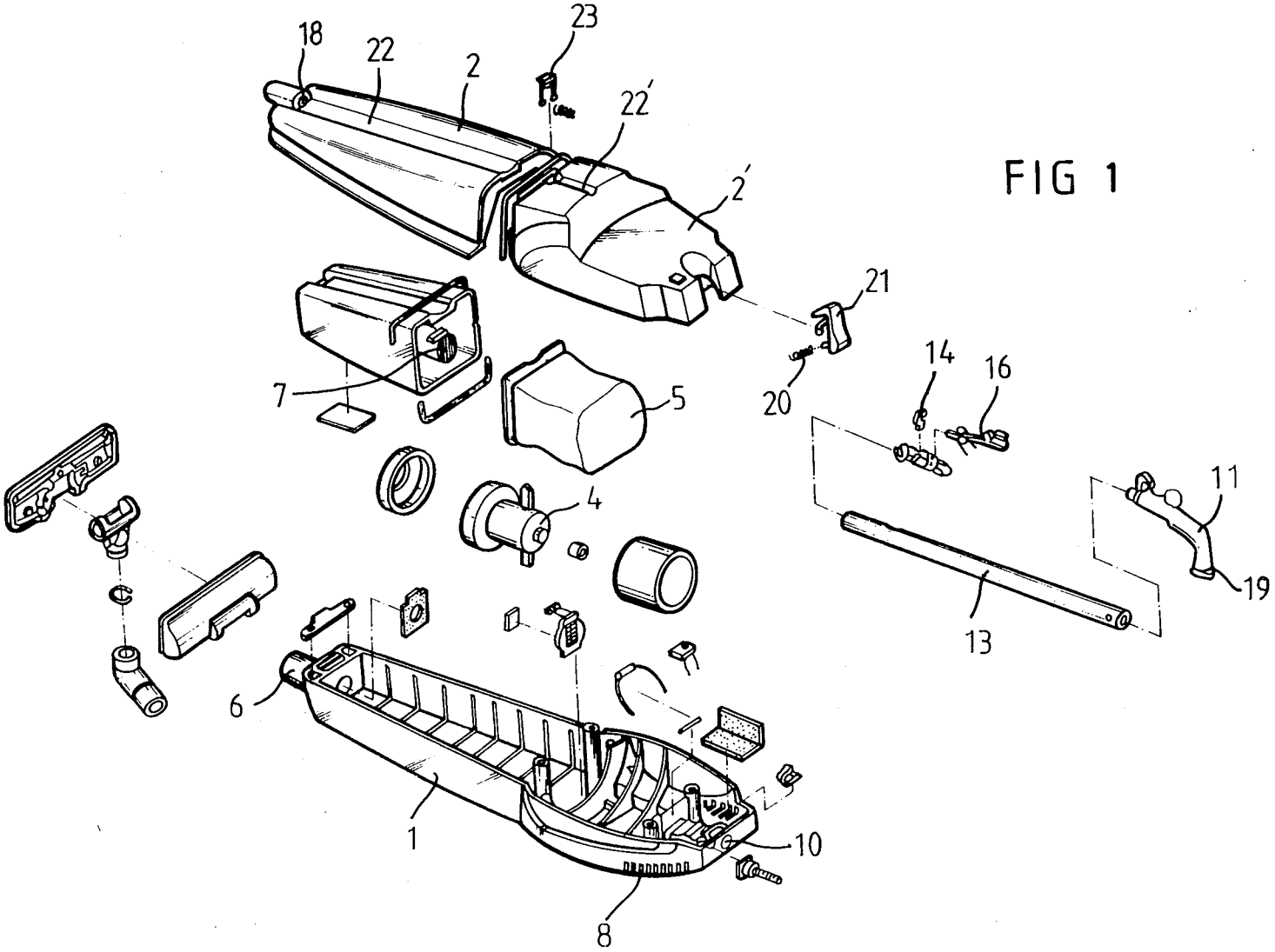
FIG. 1 is an exploded perspective view of the vacuum cleaner of the present invention.
Figure 2:
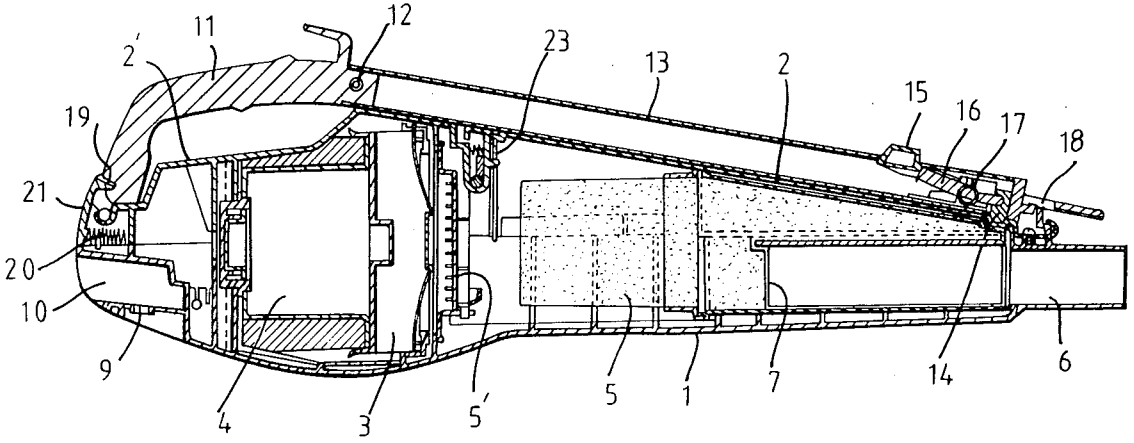
FIG. 2 is a cross-section of the vacuum cleaner of FIG. 1.
Figure 3:
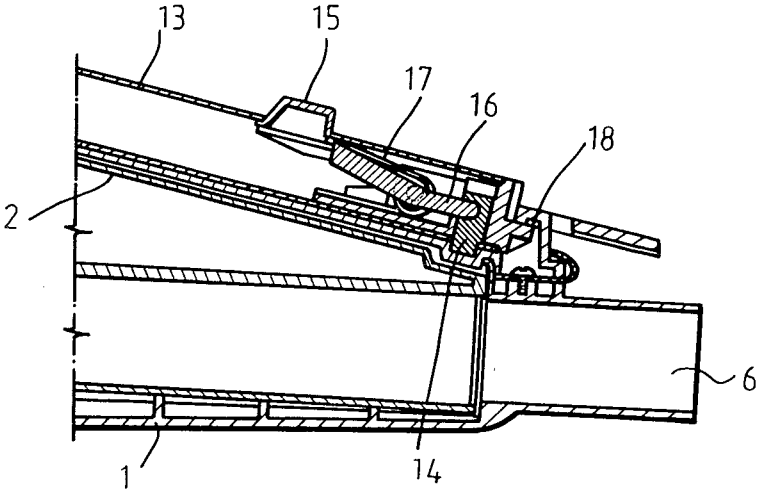
FIG. 3 is an enlarged cross-section of the portion near the suction port of the vacuum cleaner of the present invention.

Referring to FIGS. 1 and 2, the vacuum cleaner of the present invention comprises a body 1, a front upper cap 2 mounted on the front upper side of the body 1, and a rear upper cap 2' mounted on the rear upper side of the body 1. A suction fan 3, and a suction fan driving motor 4, are mounted inside body 1.

In front of suction fan 3 are provided a primary filter 5 and a secondary filter 5', which filter sucks the wastes together with the air through suction port 6. Valve plate 7 is opened by the suction force generated by the driving of suction fan 3.

The air passing the primary and secondary filters 5, 5' is discharged out through a plurality of discharging openings 8 provided in the back side of body 1. The operating principle and general construction of the vacuum cleaner of the present invention is the same as the conventional.

According to the present invention, there is provided a vacuum cleaner that is selectively adjusted to the floor-carried, upright position, or to the portable hand-carried position.

Figure 4:
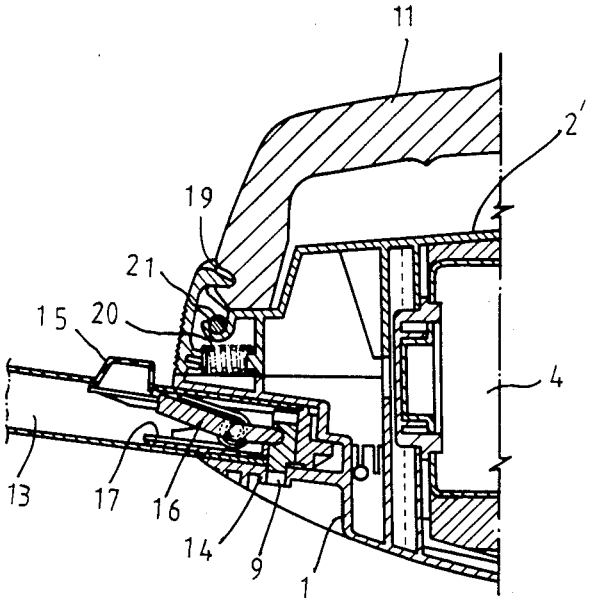
FIG. 4 is an enlarged cross-section of the portion near the discharging openings of the present invention.

Into the back side is formed a catching hole 10 having a retaining slot 9 on the wall thereof. Handle 11 is incorporated with extension member 13. On the free end of the extension member is provided a holding piece 14, which engages retaining slot 9, as shown in FIG. 4, so as to fix extension member 13, thereby transforming the vacuum cleaner into the floor-carried, upright position through the combined length of handle 11 and extension member 13.

Additionally, lever 16 is resiliently mounted on the free end of extension member 13 by torsion spring 17. On the end of lever 16, facing toward handle 11, is mounted a push-button 15, and to the other end of lever 16 is attached holding piece 14.

When separating extension member 13 from catching hole 10, push-button 15 is pushed to move upwardly to the other end of lever 16, as well as holding piece 14, so that holding piece 14 comes out of retaining slot 9, thereby separating extension member 13 from body 1.

On the other hand, when using the vacuum cleaner of the present invention in the portable hand-carried position, as shown in FIG. 2, handle 11, and extension member 13 incorporated therewith, are attached so as to longitudinally cross the middle portions of front and rear upper caps 2', 2. In order to accomplish this end, holding means 17 is immovably caught by catching means 18 formed on the front upper end of front upper cap 2, and holding piece 14 is retained by a retaining hole, thereby fixing the free end of extension member with front upper cap 2. In the free end of handle 11 is formed cut (19), which is immovably caught by hook 21 resiliently pivoted on the back side of rear upper cap 2' by spring 20.

When separating the handle, as well as the extension member, push button 15 is pushed so as to release holding piece 14 from the retaining slot, and extension member 13 is pulled back to release the free end thereof from catching means 18, while the lower end of hook 21 is pushed so as to compress spring 20. The upper end of hook 21 then pivots outwardly, releasing from cut 19, so that handle 11 is released together with extension member 13 from body 1.

In the portable hand-carried position, extension member 13 is positioned in grooves 22, 22' formed longitudinally across the middle portions of the front and rear upper caps 2, 2'.

When removing wastes filtered by filters, 5, 5', handle 11 and extension member 13 are separated from the caps 2, 2' which are in turn separated from each other by means of connecting piece 23. Filters are then taken off body 1 and the wastes therein are removed.

Figure 5:
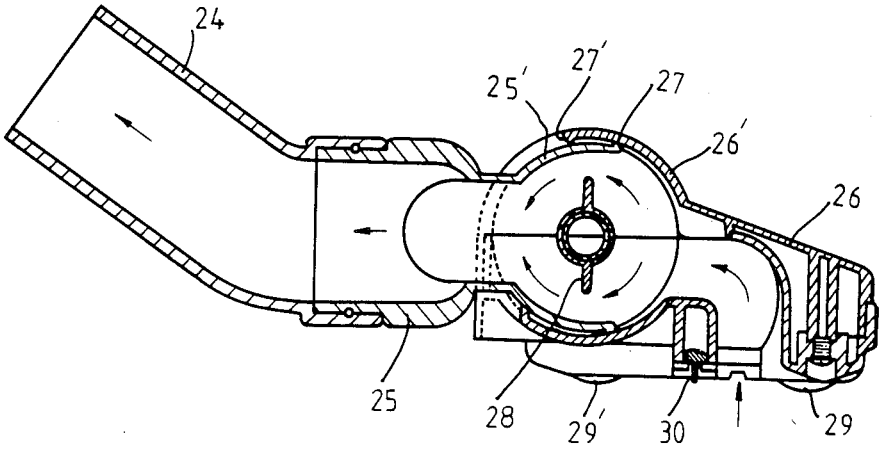
FIG. 5 is an enlarged cross-section of a suction nozzle used in the vacuum cleaner of the present invention.

FIG. 5 is a cross-section illustrating a suction nozzle used in conjunction with suction port 6 of body 1.

Connecting pipe 24 is conjoined with holding pipe 25. The front joining portion 25' of holding pipe 25, and the back portion 26' of nozzle pipe 26 connected therewith, are shaped into a hemisphere having radii different from each other. The two hemispheres are engaged with each other so as to make free rotational motions relative to each other.

In order to prevent the engagement of the two hemispheres being loosened, protuberances 27, 27' are formed respectively along the ends of the two joining portions 25', 26'. Inside the hemispheres is mounted guide plate 28. Nozzle pipe 26 has wheels 29, 29' and brush 30.

As described hereinabove, the vacuum cleaner of the present invention is selectively transformed into the floor-carried, upright position, or the portable hand-carried position, thereby making itself more effective.

What is claimed is:

1. A vacuum cleaner comprising a body having an air suction port at a front end, and a plurality of air discharging openings at a back end, an air suction means placed inside said body, a suction nozzle attached to said air suction port, a front upper cap mounted on the front upper side of said body, a rear upper cap mounted on the rear upper side of said body, a handle incorporated with an extension member, a holding means provided on the free end of said extension member, a catching means provided on the front upper end of said front upper cap, a cup formed in the free end of said handle, a hooking means provided on the back side of said rear upper cap, and a catching hole formed into the back side of said body, characterized in that when said vacuum cleaner is used as a portable hand-carried type, said holding means of said extension member, and said cup of said handle, are immovably caught respectively by said catching means and said hooking means of said rear upper cap, and when said vacuum cleaner is used as a floor-carried, upright type, said holding means is inserted into said catching hole of said body and immovably caught therein.

2. A vacuum cleaner as claimed in claim 1, characterized in that said holding means comprises a lever pivotedly mounted on the free end of said extension member with a push-button mounted on the end of said lever facing toward said handle, said pushbutton being exposed beyond the upper side of said extension member, a holding piece attached to the other end of said lever, and a torsion spring for mounting resiliently said lever on said free end.

3. A vacuum cleaner as claimed in claim 1, characterized in that said suction nozzle comprises a connecting pipe, a holding pipe conjoined with said connecting pipe, and a nozzle pipe connected with said holding pipe, the joining portions of said holding pipe and nozzle pipe being shaped into hemispheres having radii different from each other, said two hemispheres being engaged with each other so as to make free rotational motions relative to each other.

* * * * *